United States Patent [19]

Hussamy

[11] Patent Number: 4,705,523

[45] Date of Patent: Nov. 10, 1987

[54] PROCESS FOR IMPROVING THE FLAME-RETARDANT PROPERTIES OF PRINTED SHAPED ARTICLES FROM ARAMID FIBERS

[75] Inventor: Samir Hussamy, Lynchburg, Va.

[73] Assignee: Burlington Industries, Inc., Greensboro, N.C.

[21] Appl. No.: 870,524

[22] Filed: Jun. 4, 1986

Related U.S. Application Data

[63] Continuation-in-part of Ser. No. 863,011, May 14, 1986.

[51] Int. Cl.[4] ..... D06P 5/00

[52] U.S. Cl. ..... 8/490; 8/465; 8/466; 8/558; 8/574; 8/586; 8/587; 8/925

[58] Field of Search ..... 8/465, 466, 490, 586, 8/587, 574, 558

[56] References Cited

U.S. PATENT DOCUMENTS

| | | | |
|---|---|---|---|
| 2,225,603 | 12/1940 | Lubs | 8/402 |
| 2,290,945 | 7/1942 | Dahlen et al. | 8/564 |
| 2,989,360 | 6/1961 | Mautner | 8/553 |
| 3,558,267 | 1/1971 | Langenfeld | 8/586 |
| 3,741,719 | 6/1973 | Ramanathan et al. | 8/654 |
| 3,771,949 | 11/1973 | Hermes | 8/492 |
| 3,837,802 | 9/1974 | Litzler et al. | 8/549 |
| 3,884,626 | 5/1975 | Hoster et al. | 8/543 |
| 3,986,827 | 10/1976 | Dombchik | 8/527 |
| 4,059,403 | 11/1977 | Wolf et al. | 8/538 |
| 4,066,396 | 1/1978 | Wolf et al. | 8/489 |
| 4,525,168 | 6/1985 | Kelly | 8/130.1 |

OTHER PUBLICATIONS

"Dyeability of Nomex Aramid Yarn", by R. A. F. Moore et al., *Textile Research Journal,* pp. 254–260, 1985.

"Effect on Auxiliary Solvents in STX Coloration of Aramids and PBI with Cationic Dyes", in *Book of Papers, AATCC National Technical Conference,* Oct. 1983, pp. 314–326.

"Dyeing and Finishing Nomex Type 450 Aramid, *Bulletin NX-9,* Mar. 1978.

"Interactions of Nonaqueous Solvents with Textile Fibers, Part XI: Nomex Shrinkage Behavior, *Textile Res. J.,* 51, 323–331 (1981).

"Dyeability of Solvent Treated Fibers, *Book of Papers, AATCC National Technical Conference,* Moore et al., Oct. 1981, pp. 109–120.

"Interactions of Nonaqueous Solvents with Textile Fibers, Part II: Isotherman Shrinkage Kinetics of a Polyester Yarn, *Textile res. j.* 43, 176–183 (1973) Ribnick et al.

"Interactions of Nonaqueous Solvents with Textile Fibers, Part III: The Dynamic Shrinkage of Polyester Yarns in Organic Solvents, *Textile Res. Jr.,* 43, 316–325 (1973) Ribnick et al.

"Interactions of Nonaqueous Solvents with Textile Fibers, Part VII: Dyeability of Polyester Yarns After Heat and Solvent-Induced Structural Modifications, *Textile Res. J.* 46, 574–587 (1976), Weigmann et al.

"Evaluation of the STX System for Solvent Dyeing of Industrial Fabrics Part II: Kevlar Aramid and PBI Fabrics", Cook et al., *Journal of Industrial Fabrics,* vol. 2, No. 1, Summer 1983.

Dyeability of Nomex Aramid Yarn", Moore et al., *Book of Papers, 1982 Technical Conference",* pp. 94–99 (19).

"High-Temperature Fibres and Their Identification", Prof. Maria Stratmann, *Melliand Textilberichte,* (English Edition), Mar. 1982 pp. 215–219.

"A Sovlent-Dyeing Process for Aramid Fibers", J. Preston et al., *Textile Research Journal,* May 1979, Volume 49, No. 5, pp. 283–287.

*Primary Examiner*—A. Lionel Clingman

*Attorney, Agent, or Firm*—Nixon & Vanderhye

[57] ABSTRACT

A process of printing a predetermined pattern on and improving the flame resistance of a poly(m-phenyleneisophthalamide)-containing textile fabric including the successive steps of: (a) applying a print paste, composed of a highly polar solvent selected from dimethylsulfoxide, N,N-dimethylacetamide, N-methyl-2-pyrrolidone, and mixtures thereof, the polar solvent adapted to swell the aramid fiber and introduce a dyestuff therein, at least one organic dyestuff that is soluble in the polar solvent, a print paste thickening agent compatible with both the polar solvent and the dyestuff, a flame retardant and water in a predetermined pattern onto the surface of the aramid textile; and (b) drying and curing the thus printed fabric at an elevated temperature sufficient to permeate and fix the dyestuff and the flame retardant molecules inside the aramid fibers.

25 Claims, No Drawings

PROCESS FOR IMPROVING THE FLAME-RETARDANT PROPERTIES OF PRINTED SHAPED ARTICLES FROM ARAMID FIBERS

CROSS-REFERENCE TO RELATED APPLICATIONS

This application is a continuation-in-part of my earlier application Ser. No. 863,011 filed May 14, 1986.

This invention relates to a novel process for improving the fire-retardant properties of printed shaped articles derived from aramid fibers with conventional organic dyestuffs.

In particular, the present invention relates to the surprising discovery that particular print paste formulations are functional so as to enable one to print textile fabrics derived from aramid fibers with a variety of conventional organic dyestuffs to produce printed patterns of full tinctorial values having good overall fastness properties especially to washing crocking, sublimation, and light and to improve the already excellent flame resistant properties of these fibers. Disclosed is a printing process in which (1) conventional organic dyestuffs, i.e., cationic anionic, fiber reactive, disperse, vat, solvent, azoic, and mixtures thereof, together with (2) fire-retardent chemicals, as described in more detail below, are used in accordance with this invention for the printing and improving the fire-retardent properties of polyaramid fabrics.

BACKGROUND OF THE INVENTION

High molecular weight whooly aromatic polyamides or polyaramids made by the condensation or reaction of an aromatic or essentially aromatic monomeric starting material or materials described in U.S. Pat. No. 4,198,494 and sold under the trademarks Nomex by E. I. duPont de Nemours and Co., Conex by Teijin Corp., and Apyeil and Apyeil-A (Apyeil containing finely divided carbon) by Unitika Ltd. are extremely strong and durable and have excellent flame resistant properties. Shaped articles made of these polyaramid fibers such as yarn and textile fabrics are commercially important and gaining in popularity especially in the protective fabric field and other markets where the combined flame resistance and high tensile properties are essential.

A serious problem limiting the full commercial exploitation of the polyaramid fibers has been the fact that fabrics made from these highly crystalline fibers of extremely high glass transition temperature are very difficult to print into colored patterns and designs with good overall fastness properties, especially to light and washing, without adversely affecting their handle, tensile, and flame resistance properties. For many applications and uses, there is a demand for fire-retardant goods with fire-retardant properties even higher than undyed goods or printed goods.

Recently, it has been proposed in U.S. Pat. No. 4,525,168 to print aramid fabrics with anionic dyes, i.e. acid dyes, premetallized acid dyes, and direct dyes. This is accomplished by introducing into the aramid fiber dye site substances such as aromatic and aliphatic amines capable of forming ionic bonds with anionic dyes. The dye site substances are introduced and fixed inside the fiber by a special process prior to the printing operation. After printing the fabric with anionic dyestuff and drying, the printed fabric is turbo steamed under pressure to penetrate and fix the anionic dyestuff inside the fiber.

This process suffers a number of technical and economic drawbacks. It requires a special pretreatment process involving the use of specialty chemicals to provide the fiber with dye sites. Only anionic dyestuffs, i.e. dyestuffs containing one or more sulfonic acid groups or their sodium salts, can be used in the printing operation. Furthermore, it requires turbo steaming, a non-continuous operation, to penetrate and fix the anionic dyes inside the fiber in order to develop the true shade and fastness properties of the prints. Further, experienced operators report that turbo steaming of printed fabrics tends to give rise to track-off problems in production.

In another development it has also been proposed by Cook and co-workers, Effect of Auxiliary Solvents in STX Coloration of Aramids and PBI with Cationic Dyes in "Book of Papers, AATCC National Technical Conference," New Orleans, La., Oct. 5–7, 1983, pp. 314–326, to improve the screen printing of Nomex aramid fabrics. In the procedure described the Nomex aramid fabric is pretreated in certain highly polar solvents such as DMSO under suitable conditions, i.e. pad-squeezed, heated at 150° F. for 10 minutes, washed at 100° F. and dried prior to the printing operation. In this case too, the fabric has to be pretreated in a special process prior to the printing operation as outlined above. Furthermore, such pretreatment if not properly controlled, may cause drastic reductions in the tensile and mechanical properties of the fabric. Neither of these prior proposals deals with improving the fire-retardant properties of aramid fibers.

Accordingly, it is an object of the present invention to provide an improved process for the concurrent printing and improving the fire retardant (FR) properties of aramid fabrics. Another object of the invention is to provide a method whereby fabrics made of aramid fibers can be printed and fire retarded with a variety of conventional organic dyestuffs such as cationic, anionic, disperse, fiber reactive, solvent, vat and azoic, dyes; as well as mixtures thereof, together with appropriate fire retardant agent or agents, to obtain printed patterns with superior overall fastness and fire resistance properties. The process allows the use of two or more dyestuffs of different classes in the same print paste formulation, and this is believed to be unique. Still another object of the invention is to provide an improved process for the printing and fire retarding of aramid fabrics in which penetration and fixation of dyestuffs inside the aramid fiber is achieved. Finally, another object of the invention is to provide an improved process for the printing and fire retarding of aramid fabrics whereby the curing of the printed goods is carried out continuously under atmospheric pressure. Other objects of the invention will become apparent from a consideration of the description which follows.

DETAILED DESCRIPTION OF THE INVENTION

The present invention relates to the discovery that aramid fiber or products made from said fiber, such as textile fabrics, previously thought of as being very difficult to print into colored patterns and designs of good overall fastness properties without having, for example, to introduce into the fiber dye site substances in order to make them printable with anionic dyes as in U.S. Pat. No. 4,525,168, are nonetheless capable of being printed and fire retarded in a single step with a variety of organic dyestuffs using a specially formulated print paste containing a fire-retardant agent(s). This unique print paste according to the present invention is capable of swelling the aramid fiber and permeating the dyestuff and the fire-retardant agent, which are also soluble in the print paste, inside the fiber. The swollen fiber is then collapsed and allowed to shrink back to its original dimensions by subsequent drying and curing operations thereby trapping and fixing the dyestuff and fire-retardant agent inside the fiber.

Aramid fabrics can now be printed and their fire-retardant properties improved with this process thereby providing the printer with a wide range of dyestuffs, such as cationic dyes, anionic dyes, disperse dyes, fiber reactive dyes, vat dyes, azoic dyes, and solvent dyes from which to choose to print any color pattern required having outstanding overall fastness properties, especially to washing, dry-cleaning, crocking, sublimation and light, without adversely affecting the handle and excellent mechanical properties of the aramid fabrics and even improving the already excellent fire-retardant properties of the aramid fabrics.

In addition, since this process does not require the introduction of dye site substances such as aromatic and aliphatic amines inside the fiber, does not use a pretreatment process prior to the printing operation, and does not require a turbo steaming operation under pressure to develop and fix the prints, aramid fabrics can now be efficiently and economically printed and fire-retardant properties boosted in practice.

The print paste of the present invention will preferably include about 3.0 to 4.0 parts thickening agent, 70 to 85 parts highly polar solvent, and 5 to 20 parts water, and from 1 to 10 parts of a fire retardant agent; all parts are by weight. Other print paste adjuvants such as UV absorbers, antistatic agents, water repellants and other finishing and processing aids may also be present in the print paste. A tinctorial amount of at least one compatible dyestuff is, of course, included in the print paste.

The thickening agent used in the process can be any of the conventional thickeners for print pastes usable for printing textile materials such as natural starch, British gum, crystal gum, natural and etherified locust bean gums, carboxymethyl cellulose, gum tragacanth, polyacrylic acid sodium salt and sodium alginate, provided that it is soluble in the highly polar solvent or mixture of solvents used in the print paste and capable of forming a stable, homogeneous printing paste of appropriate viscosity to be able to be used in practice. Preferably the thickening agent will be of a polyacrylic acid type molecular weight range 450,000 to 4,000,000 and will be present in an amount sufficient so that the resulting print paste will have viscosity ranging between 5,000–36,000 cps.

The solvent used in the process can be any solvent capable of solvating the aramid fiber. By solvating is meant the formation of a complex between one or more molecules of the solvent and the polyaramid fiber molecules resulting in swelling of fibers and fibrids without dissolving or destroying them. Solvents such as N,N-dimethylformamide (DMF), dimethylsulfoxide (DMSO), N,N-dimethylacetamide (DMAC), and N-methyl-2-pyrrolidone (NMP), and combinations of 2 or more of these solvents have been found suitable as solvating agents in accordance with the present invention. In addition, none of these highly polar solvents cause an excessive reduction in mechanical properties.

An organic dyestuff may be used. Such dyestuffs may be selected from cationic dyes, anionic dyes i.e. acid dyes, metallized acid dyes, direct dyes; solvent dyes, disperse dyes, fiber reactive dyes, vat dyes, and azoic dyes, provided that the dye selected is soluble in the print paste and does not affect the homogenity and stability of the print paste. Combinations of these dyes can also be used in the same print paste provided that they are soluble in the print paste and do not affect the homogenity and stability of the print paste. Numerous examples of organic dyestuffs which can be used according to the present invention are given in Tables 1–7 of my co-pending application Ser. No. 863,011; the disclosure of that application is incorporated herein by reference.

Fire-retardant chemicals suitable for incorporation into the print paste must be compatible with the other components of the formulation. Below is a listing of suitable fire retardant agents:

Table I

Antiblaze 19 (Mobile Chemicals)
cyclic phosphonate compound containing 21% phosphorus (93% active), a mixture of 55% mono-ester and 45% di-ester.
Antiblaze 19T
Antiblaze 19 containing 7% water.
Pyrovatex 3887 (made by Ciba-Geigy distributed by C. S. Tanner)
hexabromocyclododecane-dispersion system
F/R P 58 (White Chemical)
XC - 5311 (Great Lakes Chemical)
based on pentabromodiphenyl oxide
Apex 401 (Apex Chemical)
Polygard 123 (Hamilton Auslander)
Pyrosan 546 (Laurel Band Product)
Pyron 650 (Chemiconics Industries)
Fyrol FR-2 (Stauffer Chemical)
Apex 197 or 212 (Apex Chemical)
Pentabromodiphenyl oxide (Great Lakes Chemical)
Pyron 5115 (Chemonics Industries)
RC 9431 (Pennwalt Chemical)
FR 1030/190 (Sandoz)
Antiblaze 78 (Mobil Chemical)
Antiblaze 77 (Mobil Chemical)
Apex 331 (Apex Chemical)
Firemaster PHT4 (Michigan Chemical)
Phosgard C-22-R (Monsanto)
Phosgard 2XC-20 (Monsanto)
Phosgard 1227 (Monsanto)
Firemaster PHT4 Diol (Michigan Chemical)
Kromine 9050 (Kiel Chemical)
Kromine 9050-XS (Kiel Chemical)
2,3-dibromopropyl methacrylate (Great Lakes Chemical)
Tibromophenexyethyl acrylate
Tribromophenoxyethylacrylate (Great Lakes Chemical)
2,3-dibromo-2-butene-1,4-diol (GAF)
K 23 (Mobil Chemical)

Any of these flame-retardant chemicals can be used in the process provided that the fire-retardant chemical selected is soluble in the print paste, does not affect the homogenity and stability of the print paste, and does not affect the color and fastness properties of the printed patterns. Combinations of two or more fire-retardant chemicals in the same print paste can also be used in the process.

The polyaramid fiber for which the present invention is particularly well suited can be in any suitable structural form i.e., light, medium and heavy weight woven and knitted fabrics of different weaves constructed from continuous filament and spun yarns of different types and counts, non-woven, felt, and carpet materials.

The terms high molecular weight aromatic polyamide or as used herein is to be understood as those described in U.S. Pat. No. 4,198,494, the disclosure of which is hereby incorporated by reference, and as meaning a high molecular weight synthetic organic polyamide made by the condensation or reaction of aromatic or essentially aromatic monomeric starting material or materials. Thus, in the case of aromatic monomeric starting material or materials the reactants are aromatic diamines and aromatic diacids (or derivatives of such acids), and the polymer repeating unit structure of the resulting aromatic polyamide in one instance may be illustrated by the following structural formula:

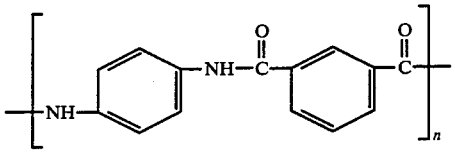

where n is an integer.

These fibers are sold under the trademarks Nomex by E. I. duPont de Nemours and Co., Conex by Teijin Corp., and Apyeil and Apyeil-A (Apyeil containing finely divided carbon) by Unitika Ltd. Fabrics made of these fibers are extremely strong and have excellent inherent flame resistance properties (which are improved by the process of this invention).

The suitability of a particular fiber or type of fiber to the process of this invention can readily be determined by a single test. Dyeing of the fiber is acceptable; staining of a candidate fiber is not. For further detailed information on the chemistry, structure, and the nature of the wholly aromatic polyamides to which this invention is applicable reference is made to Mark and Gaylord, Encyclopedia of Polymer Science and Technology, Vol. 10, 1969, pages 583–597; also Chapter 6 entitled "New Linear Polyamide" of New Linear Polymers, by Lee, Stoffey, and Neville, 1967, pages 129–169.

The process of the present invention can also be conveniently carried out using conventional printing techniques. For example, the fabric can be printed in those portions where colored patterns are required with the print paste of this invention. The thus printed fabric is dried at about 135° to 150° C. then cured for 2 to 5 minutes or so at 160° to 180° C. under atmospheric pressure. Residual unfixed dyestuffs, fire retardant, thickener and impurities from the printed goods are then removed from the textile fabric by subsequent washing treatments. Novel printed polyaramid fabrics, printed in any design or pattern, having improved fire-retardant properties are also disclosed.

DESCRIPTION OF THE PREFERRED EMBODIMENT

The foregoing and other objects, features, and advantages of the present invention will be made more apparent by way of the following non-limiting examples in which the parts and percentages noted are by weight unless otherwise indicated.

EXAMPLE 1

A plain weave polyaramid fabric made of an intimate fiber blend of 95% Nomex/5% Kevlar (duPont T-455 Nomex) weighing 4 ozs./sq. yard of staple warp and fill yarns 38/2, 26z/18s (15960 yds./lb), for use in garments offering protection against brief exposure to extreme thermal fluxes, was printed into a 100% coverage pattern composed of four colors with four different print pastes having the following compositions, expressed in percent by weight:

TABLE II

| | Lt. Green | Dk. Green | Brown | Black |
|---|---|---|---|---|
| Carbopol 934-molecular weight approximately 3,000,000 (Acrylic acid polymer sold by B. F. Goodrich) | 3.000 | 3.000 | 3.000 | 3.000 |
| Antiblaze 19 (Mobil Chemical) | 6.000 | 6.000 | 5.744 | 6.000 |
| Dimethylsulphoxide (DMSO) | 82.000 | 82.000 | 82.000 | 82.000 |
| Lanasyn Olive Green S-4GL (Acid Dye) | 0.250 | 3.000 | 2.496 | — |
| Irgalan Yellow 2GL (EX) (Acid Dye) | 0.115 | — | 3.640 | — |
| Irgalan Red Brown RL 200% (Acid Dye) | 0.115 | — | 3.120 | — |
| Irgalan Black BGL 200% (Acid Dye) | — | — | — | 7.000 |
| Water | 8.520 | 6.000 | — | 2.000 |

The fabric was then dried at 148° C. for 2 minutes, and subsequent cured for 3 minutes at 165° C. under atmospheric pressure. The cured fabric was then rinsed in cold and hot water, treated for 5 minutes in an aqueous solution of 0.5% sodium carbonate and 0.2% of nonionic detergent at 80° C., rinsed in hot water followed by cold water, and finally dried. Flammability test results of the printed fabric are given in Table 2.

COMPARATIVE EXAMPLE

The procedures of Example 1 were repeated except that no fire retardant (Antiblaze 19) was used in the print formulation. Flammability test results of the printed fabrics of both examples are outlined in Table 2.

TABLE 2

| | *Warp Direction | | | *Fill Direction | | |
|---|---|---|---|---|---|---|
| Printed Fabric | After Flame (Secs) | Char Length (Inches) | After Glow (Secs) | After Flame (Secs) | Char Length (Inches) | After Glow (Secs) |
| Example 1 | | | | | | |
| Original | 0 | 1 | 0 | 0 | 1 | 0 |
| X5 Wash | 0 | 1 | 0 | 0 | 1 | 0 |
| Example 2 | | | | | | |
| Original | 0 | 1.5 | 25 | 0 | 1.5 | 27 |

*Mean of 11 tests

Considerable improvement in fire-retardant properties, particularly in afterglow, was noted. This improvement was retained even after five washings.

Other embodiments of the invention will be apparent to one skilled in the art from a consideration of the specification or the practice of the invention disclosed herein. It is intended that the specification and examples be considered as exemplary only, with the true scope and spirit of the invention being indicated by the following claims.

What is claimed is:

1. A process of printing a predetermined pattern and improving the flame resistance of a poly(m-phenyleneisophthalamide textile fabric comprising the successive steps of:

(a) applying a print paste, consisting essentially of a highly polar solvent poly(m-phenyleneisophthalamide) fiber swelling agent selected from the group consisting of dimethylsulfoxide, N,N-dimethylformamide, N,N-dimethylacetamide, N-methyl-2-pyrrolidone, and mixtures thereof which solvent is adapted to swell the fiber and introduce a dyestuff therein, at least one organic dyestuff that is soluble in the polar solvent, at least one flame retardant that is soluble in the print paste, a print paste thickening agent compatible with the polar solvent with a viscosity in the range of about 5,000 to about 36,000 cps, and water, in a predetermined pattern onto the surface of the fabric; and (b) drying and curing the thus printed fabric at an elevated temperature sufficient to permeate and fix the dyestuff and the flame-retardant molecules inside the poly(m-phenyleneisophthalamide) fibers.

2. The process of claim 1 including the additional step of:

(c) rinsing and washing the printed and cured fabric to remove any residual print paste, unfixed dyestuff and unfixed flame retardant from the fabric.

3. The process of claim 1 in which the fabric is cured in step (b) at a temperature in the range of about 115° C. to about 190° C.

4. The process of claim 3 in which the fabric is cured for a period of from about 2 to 5 minutes.

5. The process of claim 1 in which the textile material textile fabric is composed entirely of poly(m-phenyleneisophthalamide fibers.

6. The process of claim 1 in which the print paste includes thickening agent composed of an acrylic acid polymer.

7. The process of claim 1 in which the highly polar solvent is present in an amount of between about 70 and 85% by weight.

8. The process of claim 1 in which the thickening agent is soluble in the highly polar solvent.

9. The process of claim 1 in which a UV absorber, an antistatic agent or a water repellant is also present in the print paste and is applied to the fabric.

10. A poly(m-phenyleneisophthalamide) textile fabric printed and dyed in a predetermined pattern and having improved flame resistance in which the organic dyestuff fully contacts the fibers, penetrates and dyes the fibers, produced by the process of claim 1.

11. A print paste for printing a predetermined pattern on and improving the flame resistance of poly(m-phenyleneisophthalamide) textile fabrics, the print paste consisting essentially of:

at least 70 weight percent of a highly polar solvent poly(m-phenyleneisophthalamide) fiber swelling agent adapted to swell the fiber and introduce a dyestuff and a flame-retardant therein, the polar solvent selected from the group consisting of dimethylsulfoxide, N,N-dimethylformamide, N,N-dimethylacetamide, N-methyl-2-pyrrolidone, and mixtures thereof;

a thickening amount of viscosity building print paste thickener that is compatible with the polar solvent and with a viscosity in the range of about 5,000 to about 36,000 cps;

a tinctorial amount of at least one organic dyestuff that is soluble in the print paste; and a flame retarding amount of at least one flame-retardant;

balance water.

12. The print paste of claim 11 in which the thickener is a polyacrylic acid having a molecular weight in the range of from about 450,000 to about 4,000,000.

13. The print paste of claim 11 in which the highly polar solvent is a mixture of two or more of the highly polar solvents.

14. The print paste of claim 11 in which the highly polar solvent is present in an amount of between about 70 and about 85% by weight.

15. The print paste of claim 11 in which the fire retardant is present in an amount of between about 1 and about 10% by weight.

16. A stable, homogeneous print paste for printing and dyeing a poly(m-phenyleneisophthalamide) textile fabric in a predetermined pattern and for improving the flame resistance of said textile fabric, the print paste consisting essentially, in percent by weight, of:

about 70 to about 85% of a highly polar solvent poly(m-phenyleneisophthalamide) fiber swelling agent selected from the group consisting of dimethylsulfoxide, N,N-dimethylformamide, N,N-dimethylacetamide, N-methyl-2-pyrrolidone, and mixtures thereof which solvent is adapted to swell the fiber and introduce a dyestuff and a flame retardant therein;

a tinctorial amount of an organic dyestuff soluble in the highly polar solvent and capable of dyeing and fixing in the fibers;

a flame retarding amount of at least one flame-retarding agent soluble in the highly polar solvent;

a print paste thickening agent soluble in the highly polar solvent and compatible with the organic dyestuff, the thickening agent together with the other ingredients present in an amount sufficient to provide the print paste with a viscosity in the range of about 5,000 to about 36,000 cps;

balance water.

17. The print paste of claim 16 in which the thickening agent is a polyacrylic acid having a molecular weight in the range of from about 450,000 to about 4,000,000.

18. The print paste of claim 17 in which the highly polar solvent is dimethylsulfoxide.

19. The print paste of claim 16 in which the flame retardant is present in an amount of from about 1 to about 10%.

20. The print paste of claim 16 in which the organic dyestuff is selected from the group consisting of cationic dyes, anionic dyes, disperse dyes, fiber reactive dyes, vat dyes, azoic dyes, solvent dyes, and mixtures thereof.

21. The print paste of claim 16 further including a UV absorber, an antistatic agent or a water repellent.

22. The process of claim 1 in which the print paste contains from about 5% to about 20% water.

23. The print paste of claim 11 containing from about 5% to about 20% by weight of water.

24. The print paste of claim 16 containing from about 5% to about 20% by weight water.

25. A printed, dyed, flame-resistant poly(m-phenyleneisophthalamide) woven or knit fabric having a pattern printed thereon and having a greater flame resistance than the corresponding undyed, untreated fabric.

* * * * *